US009441620B2

(12) United States Patent
Nomura et al.

(10) Patent No.: US 9,441,620 B2
(45) Date of Patent: Sep. 13, 2016

(54) SWASH PLATE OF SWASH-PLATE TYPE COMPRESSOR

(75) Inventors: Satoshi Nomura, Toyota (JP); Masanori Akizuki, Toyota (JP); Hiroshi Kanemitsu, Toyota (JP)

(73) Assignee: TAIHO KOGYO CO., LTD., Toyota-shi (JP)

( * ) Notice: Subject to any disclaimer, the term of this patent is extended or adjusted under 35 U.S.C. 154(b) by 544 days.

(21) Appl. No.: 13/883,369

(22) PCT Filed: Dec. 2, 2011

(86) PCT No.: PCT/JP2011/077964
§ 371 (c)(1),
(2), (4) Date: Jun. 4, 2013

(87) PCT Pub. No.: WO2012/074107
PCT Pub. Date: Jun. 7, 2012

(65) Prior Publication Data

US 2013/0247699 A1 Sep. 26, 2013

(30) Foreign Application Priority Data

Dec. 2, 2010 (JP) ..... 2010-269650

(51) Int. Cl.
*F04B 49/00* (2006.01)
*F04B 27/08* (2006.01)
(Continued)

(52) U.S. Cl.
CPC ..... *F04B 27/0895* (2013.01); *F04B 27/1063* (2013.01); *F04B 27/18* (2013.01); *F04B 39/00* (2013.01); *F05C 2253/12* (2013.01); *Y10T 74/18336* (2015.01)

(58) Field of Classification Search
CPC ..... F04B 27/109; F04B 27/0873
USPC ..... 91/499
See application file for complete search history.

(56) References Cited

U.S. PATENT DOCUMENTS 6,378,415 B1 4/2002 Sugiura et al.
2003/0111511 A1 6/2003 Kanayama et al.
2004/0255775 A1* 12/2004 Pitla ..... F04B 27/1072 92/71

FOREIGN PATENT DOCUMENTS

EP 0 450 847 A1 10/1991
EP 2 557 125 A1 2/2013
(Continued)

OTHER PUBLICATIONS

Second and Supplementary Notice Informing the Applicant of the Communication of the International Application (To Designated Offices Which Apply to 30 Month Time Limit Under Article 22(1)); dated Apr. 4, 2013, issued in International Application No. PCT/JP2011/077964 (Form PCT/IB/308) (1 page).
(Continued)

*Primary Examiner* — Nathaniel Wiehe
*Assistant Examiner* — Daniel Collins
(74) *Attorney, Agent, or Firm* — Westerman, Hattori, Daniels & Adrian, LLP

(57) ABSTRACT

A swash plate of a swash plate-type compressor is covered with a resin-based coating layer containing 5 to 60 mass % of spherical graphite particles having an average particle diameter of 5 to 50 μm, the balance being one or more species selected from polyimide resin and polyamide-imide resin. The spherical graphite particles excepting minute particles having a particle diameter 0.5 times or smaller the average particle diameter, have an average shape coefficient ($Y_{AVE}$) falling within a range of 1 to 4, and 70% or more in number of the spherical graphite particles have a shape coefficient (Y) within a range of 1 to 1.5, $$Y_{AVE}=\text{total}[\{PM_i^2/4\pi A_i\}]/i$$

$$Y=PM^2/4\pi A$$

wherein "total" indicates that a value in [ ] is totalized for number "i", "PM" indicates the circumferential length of one particle, "A" indicates a cross sectional area of one particle, and "i" indicates the measurement number.

7 Claims, 9 Drawing Sheets

(51) Int. Cl.

| | |
|---|---|
| ***F04B 27/10*** | (2006.01) |
| ***F04B 27/18*** | (2006.01) |
| ***F04B 39/00*** | (2006.01) |

(56) References Cited

FOREIGN PATENT DOCUMENTS

| | | | |
|---|---|---|---|
| JP | 62-010232 | A | 1/1987 |
| JP | 3-281991 | A | 12/1991 |
| JP | 5-331314 | A | 12/1993 |
| JP | 7-223809 | A | 8/1995 |
| JP | 3026269 | B2 | 3/2000 |
| JP | 2000-265953 | A | 9/2000 |
| JP | 2003-183685 | A | 7/2003 |
| JP | 2005-089514 | A | 4/2005 |
| JP | 2008-122619 | A | 5/2008 |
| JP | 2009-029884 | A | 2/2009 |
| JP | 2009-185103 | A | 8/2009 |
| WO | 02/075172 | A1 | 9/2002 |
| WO | 2011/126078 | A1 | 10/2011 |

OTHER PUBLICATIONS

Communication in Cases for Which No Other Form Is Applicable dated Apr. 22, 2013, issued in International Application No. PCT/JP2011/077964 (Form PCT/IB/345) (1 page), (PCT/ISA/217) (1 page), attachment (9 pages).

Translation of the International Preliminary Report on Patentability (PCT/IB/338) (1 page), (PCT/IB/373) (1 page) of International Application No. PCT/JP2011/077964 mailed Jun. 13, 2013 (Form PCT/ISA/237) (7 pages).

Notification Concerning Transmittal of International Preliminary Report on Patentability (Chapter I of the Patent Cooperation Treaty) dated Jun. 13, 2013, issued in International Application No. PCT/JP2011/077964 (Form PCT/IB/326) (1 page), (Form PCT/IB/373) (1 page) and (Form PCT/ISA/237) (6 pages) (Partial translation).

WrittenOpinion of PCT/JP2011/077964, mailing date of Feb. 28, 2012.

International Search Report for PCT/JP2011/077964, mailing date of Feb. 28, 2012.

"Special Issue on Tribology in Automotive Auxiliaries and Electrical Components", Journal of Japanese Society of Tribologists, vol. 55, No. 9, pp. 10-12, (2010), Cited in Specification; With English partial Translation.

"Special Issue on Characteristics and Application of Various Types of Tribo-Materials", Journal of Japanese Society of Tribologists, vol. 49, No. 7, p. 561, (2004), Cited in Specification; With English partial translation.

"Special Issue on Tribology of Carbon Materials", Journal of Japanese Society of Tribologists, vol. 54, No. 1, pp. 6-7, (2009), Cited in Specification; With English partial translation.

* cited by examiner

SWASH PLATE OF SWASH-PLATE TYPE COMPRESSOR

TECHNICAL FIELD

The present invention relates to a swash plate of a swash plate-type compressor. More particularly, the present invention relates to a swash plate coated with a resin-based sliding material, in which graphite particles are bonded to polyimide and/or polyamide-imide resin.

BACKGROUND TECHNIQUE

The prior art is described hereinafter with respect to a swash plate-type compressor, a resin-based coating layer covering the swash plate of a swash plate type compressor, a resin-based sliding material other than the one used for a swash plate-type compressor, spherical carbonaceous material, and then sliding properties of graphite.

Swash Plate Type Compressor

Existing variable-displacement swash plate-type compressors have a structure shown, for example, in FIG. 1. This drawing is from Patent Document No. 1: Japanese Unexamined Patent Publication (kokai) No. 2003-183685. The referential numerals in the drawing indicate the following parts or positions: 10—cylinder block; 12—cylinder bore; 14—single head piston; 16—front housing: 18—rear housing (suction port and supply port are not shown in the drawing); 20—valve plate (valve and port are not shown in the drawing); 21—housing; 22—suction chamber; 24—exhaustion chamber; 50—rotary shaft; 60—swash plate; 61—through hole; 62—rotary plate; 64—thrust bearing; 66—hinge mechanism; 67—arm; 68—guide aperture; 69—guide pin; 70—engagement; 72—head; 76—shoe; 80—guide aperture; 86—swash-plate chamber; 87—compression chamber; 90—schematically shown electro-magnetic valve; 100—exhaust channel; 102—supporting aperture.

Patent Document 1 describes the following operating mechanism of a variable-displacement swash plate-type compressor. An exhausting chamber 24, which is on the high pressure side, and a suction chamber 22, which is on the low pressure side, generate a pressure difference, which is utilized to regulate the pressure within a swash-plate chamber 86. The front and rear sides of a piston 14 are exposed to the pressure in a compression chamber 87 within a cylinder bore 12. The difference between this pressure and the pressure of the swash-plate chamber 86 is regulated to change the inclination angle of a swash plate 60. As a result, the stroke of the piston 14, and hence the exhausting volume of the compressor, is adjusted. Specifically, an electro-magnetic valve 90 is switched on or off to control the pressure in the swash-plate chamber 86, and, in turn, the swash-plate chamber 86 is communicated or disconnected with the exhaustion chamber 24.

FIG. 2 is an enlarged schematic view of essential parts of the swash plate-type compressor shown in FIG. 1. In FIG. 2, the shoe clearance between a shoe 76 and the swash plate 60 is denoted by 120. In an enlarged view of the shoe shown in FIG. 3, 76*a* denotes a flat plane; 76*b*, a spherical plane; and 76*c*, an abutting surface with a piston. The shoe 76 is a semi-spherical member typically manufactured through quenching SUJ2, followed by finishing. An intermediate layer is formed through thermal spraying, plating, or chemical conversion on the surface of a steel material, and resin-based surface treatment is applied via the intermediate layer on the top surface of the swash plate.

The shoe 76 is a sliding member located between the swash plate 60 and the piston 14, as is shown in FIGS. 2 and 3. Since the piston-facing surface of the shoe 76 is a spherical plane 76*b*, the shoe 76 is capable of oscillating depending upon the change in inclination angle of the swash plate. The rotating swash plate 60 is positioned aslant and oscillates with respect to the axial line of the compressor, while both surfaces of the swash plate 60 slide on the flat plane 76*a* of the shoe. Since the middle portion of the flat plane 76*a* of the shoe is slightly convex (not shown in the drawing), oil film is formed on this plane, thereby decreasing the friction resistance with respect to the swash plate 60.

Surface Treatment of Swash Plate by Resin-Based Sliding Material

According to the prior art, a sliding coating layer, which is based on polyimide or polyamide-imide, is provided on the swash plate of a swash plate-type compressor. Related prior art documents are: Patent Document 1—Japanese Unexamined Patent Publication (kokai) No. 2003-183685; Patent Document 2—Japanese Unexamined Patent Publication (kokai) No. 2000-265953; Patent Document 3—Japanese Unexamined Patent Publication (kokai) No. 2005-89514; and, Patent Document 4—WO02/075172A1.

The coating layer provided on the surface of a steel-based swash plate in Patent Document 1 is formed of solid lubricant, such as $MoS_2$, PTFE, or graphite, such metallic powder of Ni, Fe, Mn, Cr or Mo having a particle diameter of 20 nm, and a polyamide-imide binder.

A liquid mixture of resin, such as polyamide-imide resin or polyimide resin and a metal or alloy powder having a particle size of 10 to 100 μm are baked on the surface of a swash plate to form a coating layer in Patent Document 2. The metal is for example Sn, Ag, Al, Cu, Zn, Ni, Si, Co, Ti, W, Mo, Mg or Fe. The alloy is of these metals.

In Patent Document 3, a solid lubricant is bonded to at least one binder selected from the group consisting of polyamide-imide, polyimide and epoxy resin. The solid lubricant contains 10 to 40 vol. % of molybdenum disulfide, 10 to 40 vol. % of flake-shaped graphite or scale-shaped graphite, and 1 to 40 vol. % of polytetrafluoroethylene. The total amount of the solid lubricants is 30 to 60 vol. %. In Patent Document 4, the following proposals are made. The swash plate of a swash-plate compressor is coated with a solid-lubricant coating layer produced from polyamide-imide resin and at least one of PTFE and graphite. In addition, concentric grooves and convexities between the neighboring grooves are provided on the sliding surface. It is described that synthetic graphite of high crystallization degree is preferred.

Non-Patent Documents: Tribologist Vol. 55, No. 9 (2010), pages 10-12 illustrates trends of a swash-plate compressor used for automotive air-conditioning. In a compressor in which an alternative fluorocarbon cooling medium HFC1113a is used, seizure is more likely to occur than in a compressor using a fluorocarbon cooling medium CFC12. Therefore, an intermediate layer formed of flame-sprayed copper-based material such as Cu—Pb and Cu—Si is provided on the iron-based swash plate in the variable-displacement type compressor, and the resin-based coating layer containing a solid lubricant is provided on the intermediate layer.

Sliding Material Used in Parts Other than Swash Plate of Swash Plate Compressor

Hitherto, a polyether-ether ketone-based resin bearing has been used as a bearing of a motor for information media such as a hard disc and DVD disc according to Patent Document 5: Japanese Unexamined Patent Publication (kokai) No. 2009-185103. This patent document proposes to replace the conventional motor bearing with a bearing, which contains (a) 100 parts by weight of a thermoplastic resin including polyarylene sulfide resin and aromatic polyamide-imide resin, (b) 1 to 50 parts by weight of such a spherical filler as a ceramic balloon, "sirasu" (a Japanese word) balloon, a glass balloon, a metallic balloon, ceramic particles, silica, glass beads, and metallic powder, and (c) 1 to 50 parts by weight of solid lubricant. It is described that scale-shaped graphite, nodular graphite, flat-sheet-shaped graphite and spherical graphite can be used, but scale-shaped graphite is preferred.

Spherical Carbonaceous Material

In Patent Document 6: Japanese Patent No. 3026269, the present applicant proposed a polyamide-imide resin-based sliding material containing 5 to 80% by weight of heat-treated and dispersed resin particles essentially individually isolated from each other. These particles are formed by heat treating and spheroidizing phenol resin.

Patent Document 7: Japanese Unexamined Patent Publication No. Hei 5-331314 proposes a heat-resistant resin sliding material composed of 40 to 95% by weight of a heat resistant resin such as polyimide resin, and 5 to 60% by weight of spherical graphite having an average particle diameter of 3 to 40 μm, which is obtained by calcining resin-based spherical particles in an inert-gas atmosphere or vacuum. The spherical graphite is described as follows. Preferably, the spherical graphite has a uniform particle diameter, an average-particle diameter of 3 to 40 μm, and geometrically highly spherical shape. Preferably, the starting material of the spherical graphite is at least one of phenol resin, naphthalene resin, furan resin, xylene resin, divinylbenzene polymer, and styrene-divynilbenzene copolymer. A method for producing such spherical graphite comprises subjecting these starting materials to known emulsion polymerization to produce spherical particles, and calcining the resultant spherical particles in an inert gas protective atmosphere or vacuum, thereby carbonizing and/or graphitizing the same.

Spherical carbon particles disclosed in Patent Document 8: Japanese Unexamined Patent Publication (kokai) Hei 7-223809 has a highly oriented, quasi-graphite crystal structure. These spherical fine graphite particles are isotropic. Various resins in which spherical carbon particles are dispersed can be used as the sliding member. These fine carbon particles are meso phase microbeads (mesocarbon microbeads), coal tar, coal tar pitch, asphalt and the like, which are heat-treated at 350 to 450 degrees C. to yield spherical crystals. They are separated from coal tar and the like and is then finely divided, followed by graphitization at 1500 to 3000 degrees C. During this process, spheroidization proceeds according to the description. However, the meso phase microbeads shown in the microscope photograph of that publication are considerably deformed from the geometrically spherical shape.

Sliding Properties of Graphite (a) Graphite is a material having a laminar crystal structure, in which (002) planes are superimposed. Slip is likely to occur between these planes. This property is utilized to realize the low-friction property.

(b) Graphite having a higher degree of graphitization is closer to natural graphite. Such graphite is soft and well lubricating. Graphite having a lower degree of graphitization is hard carbon. A hard carbon-particle additive is used to improve wear resistance and to control friction. Meanwhile, high degree of graphitization and improved lubricating property of flake-shaped graphite is believed to be utilized in Patent Document No. 3. The spherical graphite having highly near-sphere shape proposed in Patent Documents Nos. 6 and 7 is believed to be hard carbon.

PRIOR ART DOCUMENTS

Patent Documents

Patent Document 1: Japanese Unexamined Patent Publication (kokai) No. 2003-183685

Patent Document 2: Japanese Unexamined Patent Publication (kokai) No. 2000-265953

Patent Document 3: Japanese Unexamined Patent Publication (kokai) No. 2005-89514

Patent Document 4: WO 02/075172A1

Patent Document 5: Japanese Unexamined Patent Publication (kokai) No. 2009-185103

Patent Document 6: Japanese Patent No. 3026269

Patent Document 7: Japanese Unexamined Patent Publication (kokai) No. Hei 5-331314

Patent Document 8: Japanese Unexamined Patent Publication (kokai) No. Hei 7-223809

Non-Patent Documents

Non-Patent Document 1: Tribologist Vol. 55, No. 9 (2010), pages 10-12.

Non-Patent Document 2: Tribologist Vol. 49, No. 7 (2004), page 561.

Non-Patent Document 3: Tribologist Vol. 54, No. 1 (2009), pages 6-7

DISCLOSURE OF INVENTION

Problems to be Solved by Invention

Most of the existing compressors used for air-conditioning of an automobile are clutch-less type and are constantly rotated during driving of an automobile. When a compressor for air-conditioning is not driven, cooling medium and lubricating oil are not circulated in the compressor. Therefore, lubrication is liable to become poor. Recently, in order to increase the refrigerating efficiency of a compressor for air-conditioning of an automobile, the amount of pre-charged oil is decreased. Therefore, lubrication is likely to be worsened further. In addition, power of a compressor should be lowered to improve the fuel consumption of an automobile. In order to decrease power of a compressor under poor lubrication, friction between the shoes and swash plate must be decreased.

Generally, when a resin-based coating layer on the swash plate of a swash-plate compressor is worn out, an intermediate layer is exposed to the surface. The intermediate layer has high bonding strength with the upper and lower layers, as well as a certain level of sliding properties. Nevertheless, seizure between the shoe and intermediate layer becomes likely to occur. When the iron-based shoes are brought into direct sliding with an iron-based swash plate without intermediation of an intermediate layer, sliding occurs between the iron-based materials, so that the seizure is highly likely to occur. The present applicant proposed in Patent Document 4 a coating layer, which is formed of PTFE and/or graphite and polyamide-imide resin, for the purpose of mainly enhancing low-friction properties. Improvement in wear resistance is not contemplated in this patent document. It turned out that, when the lubrication conditions become to be extremely deteriorated in a compressor using an alternative cooling medium, wear between the shoe and swash plate is likely to occur. In addition, a flame-sprayed copper intermediate layer is used in swash plate compressors, because the resin-based coating layer is not completely reliable. This intermediate layer makes a compressor expensive, because the price of copper used in the intermediate layer has recently soared.

It is an object of the present invention to improve wear resistance and low-friction property of a resin-based coating layer formed on the swash plate of a swash-plate compressor, particularly, a displacement-variable swash plate compressor, operated under poor lubricating conditions. It is another object of the present invention to provide a resin-based coating layer on a swash plate of a swash-plate compressor, which coating layer can attain improved sliding properties without use of an intermediate layer.

Means for Solving the Problems

The present invention provides a swash plate of a swash plate-type compressor having shoes and a swash plate which slides thereon, and is characterized in that the swash plate is covered with a coating layer which contains 5 to 60 mass % of spherical graphite particles having an average particle diameter of 5 to 50 μm, with the balance being one or more species selected from polyimide resin and polyamide-imide resin. The spherical graphite particles, excepting minute particles having a particle diameter 0.5 times or smaller than the average particle diameter, have an average shape coefficient (YAvE), as defined below, falling within a range of 1 to 4.70% or more, in number, of the spherical graphite particles have a shape coefficient (Y) within a range of 1 to 1.5.

$$Y_{Ave}=\text{total}|[PM_i^2/4\pi A_i]|/i$$

$$Y=PM^2/4\pi A$$

Here, "total" indicates that a value in [ ] is totalized for number "i", "PM" indicates the circumferential length of one particle, "A" indicates a cross sectional area of one particle, and "i" indicates the measurement number. The present invention is hereinafter described in detail.

Typically, graphite is classified into two types, that is, natural graphite and synthetic graphite. It is however sometimes classified roughly into three types, that is, expanded graphite in addition to the above two types. Natural graphite is classified into scale-shaped graphite, flake-shaped graphite, and graphite having soil appearance. Pulverized synthetic graphite electrode, graphitized petroleum tar or cokes, and meso-phase micro beads are included in the synthetic graphite. The scale-shaped graphite may be referred to as nodular graphite. Not only production methods of these types of graphite are different from each other, but also appearances can be clearly distinguished from each other. Recently, a spheroidizing pulverizing technique has been developed. The produced spheroidized graphite or spherical graphite is commercially available (Technical data of Japan Graphite Industries Co., Ltd., product name CGC-100, 50, 20; Home page of ITO GRAPHITE; http://www graphite-.co.jp/seihin.htm). Spherical graphite used in the present invention has a considerably higher particle ratio than any of the commercially available flake-shaped graphite, graphite having soil appearance, or thin-sheet-shaped graphite and the like.

FIG. 4 schematically illustrates a coating layer according to claim 3 of the present invention, in which spherical graphite particles 115*b* and $MoS_2$ particles 114 are dispersed. In FIG. 4, 110 denotes an iron-based substrate or intermediate layer (hereinafter referred to as "iron-based substrate 110"), 112 a resin-based coating layer, 115*b* spherical graphite particles, and 113 a polyimide or polyamide-imide resin binder (hereinafter referred to as "the resin-based binder 113"). The resin-based coating layer 112 has a compatible surface with an opposite shaft, which surface is schematically shown as a flat plane.

The structure of the swash plate of a swash plate-type compressor according to the present invention is first described. Copper or aluminum can be used instead of iron of the iron-based substrate 110. In one embodiment, where sliding of materials of the same type occurs between the iron-based substrate and shoe, advantages of the present invention will be demonstrated. An intermediate layer is not necessary but a sintered copper intermediate layer, a flame-sprayed Cu, Al, Cu—Al intermediate layer or the like may cover the surface of iron-based substrate 110.

Spherical graphite particles 115*b*, excepting minute particles having a particle diameter 0.5 times or smaller than the average particle diameter, have an average shape coefficient ($Y_{AVE}$), as defined below, falling within a range of 1 to 4, preferably 1 to 2.5. In addition, 70% or more, in number, of the spherical graphite particles 115*b* have a shape coefficient (Y) of 1 to 1.5.

$$Y_{AVE}=\text{total}|[PM_i^2/4\pi A_i]|/i$$

$$Y=PM^2/4\pi A$$

Here, "total" indicates that a value in [ ] is totalized for number "i", "PM" indicates the circumferential length of one particle, "A" indicates a cross sectional area of one particle, and "i" indicates the measurement number. The circle-equivalent diameter and shape coefficient of a graphite particle are measured as follows.

A swash plate is cut at an arbitrary position. A visual field of 0.37 mm×0.44 mm on a cut surface is photographed at a magnification of 200 times. The image of the resin coating layer is converted to binary image by means of, for example, LUZEX-FS produced by Nicolet Co., Ltd. The binary image is measured to obtain the circle-equivalent diameter and the shape of each graphite particle.

The average diameter D of spherical graphite particles 115*b* and the thickness t of the resin-based coating layer 112 preferably have a relation of $0.1\ t<D<1.0\ t$, more preferably $0.25\ t<D<0.67\ t$. The resin-based coating layer 112 preferably has a thickness t of 5 to 50 μm, more preferably 10 to 40 μm.

Spherical graphite particles 115 according to the present invention have a degree of graphitization of 0.6 or more, with the proviso that the degree of graphitization of perfect graphite crystal is 1. The spherical graphite particles 115 may be natural graphite or close to natural graphite, and therefore have improved lubrication property and compatibility. The spherical graphite particles 115*b* preferably have a degree of graphitization of 0.8 or more. The degree of graphitization is defined by C. R. Houska's equation stated in Non-Patent Document 2: Tribologist Vol. 49, No. 7 (2004), page 561, "Method for Using Carbon Material". The spherical graphite particles 115*b* are blended in the resin-based coating layer 112 at a proportion of preferably 5 to 60 mass %, more preferably 10 to 50 mass % based on the total.

Balance of the above-mentioned spherical graphite particles 115*b* is a resin-based binder 113 composed of polyimide (PI) resin and/or polyamide-imide (PAI) resin. Polyester imide, aromatic polyimide, polyether imide, bismaleic imide in liquid form or solid powder form can be used as the polyimide. Aromatic polyamide-imide resin can be used as the polyamide-imide resin. Improved heat resistance and low coefficient of friction are characteristic features provided by these resins.

Referring to FIG. 4, $MoS_2$ particles 114 are added as a solid lubricant. However, even in the absence of $MoS_2$ particles 114, improved sliding properties are attained, because the spherical graphite particles 115*b* are difficult to separate from the resin-based binder 113 and maintain the effects of solid lubricant.

The resin-based coating layer 112 according to the present invention may further contain one or more species of $MoS_2$, PTFE, $WS_2$, h-BN, and CF (fluorinated graphite), which are common solid lubricants, in an amount of 1 to 70 mass %, with the proviso that the total content of the solid lubricant and spherical graphite is 10 to 80 mass %. A total amount of spherical graphite and solid lubricant at less than 10 mass % is not very effective. When the solid lubricant alone exceeds 70 mass %, or when the total content of spherical carbon and solid lubricant exceeds 80 mass %, drawbacks such as reduction in heat resistance or strength of the resin-based coating layer 112 become apparent. The particle diameter of a solid lubricant is preferably 0.5 to 50 μm, more preferably 1 to 20 μm.

According to the present invention, oxides such as alumina and silica, nitrides such as SiN, carbides such as SiC, and sulfides such as ZnS may further be blended as hard particles in the resin-based coating layer 112. The blending amount of these hard particles is preferably 0.2 to 7 mass %, more preferably 1 to 5 mass %. The particle diameter of the hard particles is preferably 0.01 to 3 μm, more preferably 0.01 to 1 μm.

A plurality of concentric circumferential grooves 140 (FIGS. 5(*a*), 5(*c*)) or spiral grooves 140 (FIG. 5(*b*)) may be formed on the surface of the resin-based surface coating layer 112 according to the present invention. Convexities protrude between the grooves. Wear of resin occurs predominantly on the top portions of the convexities to deform the shape of convexities. Therefore, the convexities contribute to rapidly attain delicate contact between the convexities and a shoe. Consequently, the convexities promote initial compatibility between the coating layer and a shoe. The depth of grooves (height of convexities) is usually approximately 1 to 20 preferably 1 to 7 μm. The pitch of grooves (distance between bottoms of neighboring convexities) is usually approximately 0.05 to 1 mm, particularly preferably 0.1 to 0.5 mm. Neither roughening nor cracking occur on the surface of a resin-based coating layer 112, when it has been subjected to initial compatibility step, as described hereinafter.

The resin-based coating layer according to the present invention can be formed by a method of blending the spherical graphite particles, polyamide-imide resin and other additives, and applying the mixture by roll coating, spraying coating, spin coating, pad printing and the like. The resin-based coating layer according to the present invention may be subjected to surface-roughness adjustment by means of mechanical working such as machining, polishing and the like. Preferably, a plurality of concentric grooves or a single or plural spiral grooves are formed on the surface of the resin-based coating layer, and a ridge is formed between the adjacent grooves. Since the spherical graphite particles hardly separate from the surface, fine surface roughness can be maintained, thereby enhancing seizure resistance. The grooves and convexities further enhance seizure resistance.

Effects of Invention

Generally, cleavage of the graphite particles having larger particle diameter is more likely to occur on the sliding surface. In this case, decrease of friction can be expected.

FIG. 6 illustrates a conventional resin-based coating layer 112. The graphite particles 115*a* in flake shape are oriented in the resin-based coating layer 112. This orientation is described in item (a) below. When a flake-shaped graphite particle 115*a* having a particularly large diameter separates from the sliding surface, the particle as a whole is likely to separate as shown in FIG. 7. Upon separation of the flake-shaped graphite particles, surface roughening and cracking occur as described in the following items (b) and (c), respectively.

(a) Orientation

Since the flake-shaped graphite particles 115*a* are in sheet form, cleavage planes are parallel to the sheet plane of the graphite particles. Among the flake-shaped graphite particles 115*a* present in the resin-based binder 113, few particles (115*a*') are oriented in parallel in the sliding direction. Most of the graphite particles are aligned in a direction perpendicular to the surface of the iron-based substrate 110 or aligned aslant. Among the aligned flake-shaped graphite particles 115*a*', those present on the very surface of a coating layer cleave and wear out, while most of the other particles held in the coating layer subsequently cleave. Low friction property is exhibited during the repeated cleavage process mentioned above. Meanwhile, the cleavage direction of the other, perpendicularly or obliquely oriented flake-shaped graphite particles is not coincident with the machining direction or sliding direction.

(b) Surface Roughening

The depth of recesses 116 (FIG. 7) becomes larger with the increase in particle diameter of graphite particles, thereby roughening the sliding surface. Among the flake-shaped graphite particles 115*a* dispersed in the resin-based binder 113, some portion of the graphite particles are inevitably brought into surface contact with one another. When a swash plate is subjected not only to rotation but also to oscillation, the contacted flake-shaped graphite particles separate from the sliding surface as contacted. In other words, the inter-particle separation is difficult to occur. As a result, the surface of a sliding layer, from which graphite particles separate, has a deep recess 116 (FIG. 7) and coarse roughness. Oil film becomes discontinuous in deep recesses, and hence wear proceeds. Non-Patent Document 3: Tribologist Vol. 54, Vol. 1 (2009), pages 6-7, "Tribology of Graphite Material") discloses a concept that scale-shaped graphite adheres to one another and loses lubrication. In this regard, since the spherical particles according to the present invention are round and free of edges, no edge contact occurs at all.

(c) Generation of Cracks

Flake-shaped graphite particles 115*a* are likely to separate from the sliding surface. The separated potion of the sliding surface becomes a defect 116' (FIG. 7) having edges, from which a crack originates. Adjacent flake-shaped graphite particles 115*a* facilitate propagation of cracks. As the increase in particle diameter of flake-shaped graphite particles 115*a*, the crack extends to the iron-based substrate 110 and peel the resin-based coating layer 112 from the iron-based substrate 110.

(d) Summary of Flake-shaped Graphite Particles

Flake-shaped graphite particles 115*a* are soft and are likely to cleave. Low friction is expected, because cleavage of graphite takes place on the sliding surface. However, since the flake-shaped graphite particles separate from the sliding surface, wear resistance and low-friction property are not achieved together. In order to avoid such problems, the flake-shaped graphite particles 115*a* must have a small particle diameter.

By contrast, the spherical graphite particles 115*b* (FIG. 4) are strongly held by the polyamide-imide resin. When the spherical graphite particles 115*b* are embedded in the resin at a half or more of the diameter of particles, their separation is difficult to occur, and, hence, wear resistance is improved. As long as the graphite is not separated but is held in the resin-based binder 113, cleavage of graphite occurs during operation of a compressor. Spherical graphite particles 115*b* attain low friction property as described above. Although spherical graphite particles 115*b* may be separated from the surface, the recess 116 (FIG. 8) left after separation is not very deep, because of the following orientation and contact.

Orientation tendency of spherical graphite particles 115 in a particular direction is not appreciable. That is, these particles are oriented in all directions. Mutual contact of spherical graphite particles are point contact. As a result, the resin-based coating layer 113 is difficult to peel, thereby making it unnecessary to provide an intermediate layer, leading to a considerable cost reduction. Consequently, the polyamide-imide based coating layer according to the present invention exhibits wear resistance and low-friction property in combination, and improves seizure resistance.

EMBODIMENTS OF INVENTION

As is described hereinabove, FIGS. 4 and 6 through 8 show the surface of the resin-based coating layer 112, which has been subjected to compatibility action with an opposite shaft. Meanwhile, the grooves (convexities) are formed on the resin-based coating layer shown in FIG. 5. The grooves (convexities) 140 may be formed on the resin-based coating layer 112 shown in FIGS. 4 and 6 through 8. A number of convexities or grooves are arranged in a direction perpendicular to the sheet of the drawings of FIGS. 4 and 8. The sliding direction is parallel to and horizontal on the sheet of drawings. The drawings FIGS. 4 and 8 show cross sections crossing at the top of convexities in a direction parallel to the ridges of convexities. When the convexities are subjected to compatibility action, their height is decreased. When sliding occurs under the conditions described hereinabove, the properties of spherical graphite particles constantly contribute to sliding performance.

The present invention is described in detail with reference to the following examples.

EXAMPLES

Example 1

Separation Test of Graphite Particles

The following starting materials were used to produce a resin-based coating layer.

(1) Flake-shaped graphite: a product of Nippon Graphite Industries; average particle diameter—15 μm; degree of graphitization—0.75. The average shape coefficient ($Y_{AVE}$) defined hereinabove broadly disperses in a range of 1 to 10. Most particles are deformed from the spherical shape.

(2) Spherical graphite: spheroidized graphite produced by Nippon Graphite Industries; average particle diameter—10 μm; degree of graphitization—0.6. The average shape coefficient (YAvE) defined hereinabove falls within a range of 1 to 4.80% or more, in terms of number, of the particles have a shape coefficient (Y) from 1 to 1.5.

(3) Polyamide-imide resin: HPC-6000-26, product of Hitachi Kasei Industries.

The above mentioned starting materials was blended as follows to prepare a paint composition. The paint was pressed and applied on the iron-based substrate. Baking was then carried out at a curing temperature of the resin-based coating to form coating.

(a) Example of spherical graphite particles
Spherical graphite particles—30 mass %.
$MoS_2$ particles—25 mass %
Polyamide-imide binder—the remainder (b) Comparative example of flake-shaped graphite particles
Flake-shaped graphite particles—30 mass %.
$MoS_2$ particles—25 mass %
Polyamide-imide binder—the remainder A machining test of the resin-based coating layer was carried out under the following conditions.

Working Machine: general purpose turning machine (dry)
Nose R of Cutting Tool: 0.4 mm R
Working Pitch: 0.025 mm/rev The machined surface was observed under a scanning type electron microscope.

FIG. 9—example of spherical graphite particles (a)—magnification of 100 times FIG. 10—example of spherical graphite particles (b)—magnification of 200 times FIG. 11—comparative example of flake-shaped graphite particles—magnification of 100 times FIG. 12—comparative example of flake-shaped graphite particles—magnification of 200 times.

In these drawings, white portions are edges of the concavities. It is apparent from these drawings that the number of the separated portions of the graphite in inventive examples (FIGS. 9 and 10) is less than that of the comparative examples (FIGS. 11 and 12). FIG. 13 shows surface roughness of an inventive product and a conventional product (comparative example). From this drawing, it is apparent that the roughness of the former is less than that of the latter.

Example 2

Test of Swash Plate-Type Compressor

Composition of the resin-based coating layer produced in Example 1 was changed as follows, and solid lubricant was used. Wear resistance and coefficient of friction was measured under the following condition.

(1) $MoS_2$—a product of Sumiko Lubricant Corporation, average particle diameter—1.5 μm
(2) PTFE—product of Kitamura Corporation—average particle diameter—5 μm or less
(3) $WS_2$—product of Nippon Lubricant Corporation, average particle diameter—2 μm
(4) h-BN—product of Denki Kagaku Kogyo Corporation, average particle diameter—10 μm
(5) CF—product of Central Glass Corporation, average particle diameter—2 μm Number of Revolution—9500 rpm Load—519—1735 N (successive increase)

Environment—mixture of cooling medium/ice machine oil, suction environment of compressor Opposite Material Shoe (SUJ2)

TABLE 1

| Classification | No | Film Thickness of Resin Layer [μm] | Components: Resin PAI | Resin PI | Graphite Amount (mass %) Spherical | Graphite Amount (mass %) Flake shaped | Graphite Degree of Graphitization | Graphite Particle diameter [μm] |
|---|---|---|---|---|---|---|---|---|
| Comparative | 1 | 18 | bal | — | — | 21 | 0.7 | 1 |
| | 2 | 16 | bal | — | — | 14 | 0.7 | 1 |
| | 3 | 25 | bal | — | 21 | — | 0.3 | 12 |
| Inventive | 1 | 26 | bal | — | 21 | — | 0.9 | 10 |
| | 2 | 25 | bal | — | 13 | — | 0.9 | 10 |
| | 3 | 25 | bal | — | 14 | — | 0.9 | 10 |
| | 4 | 25 | bal | — | 20 | — | 0.9 | 10 |
| | 5 | 26 | bal | — | 21 | — | 0.9 | 10 |
| | 6 | 24 | bal | — | 24 | — | 0.9 | 10 |
| | 7 | 24 | bal | — | 31 | — | 0.9 | 10 |
| | 8 | 19 | bal | — | 31 | — | 0.9 | 10 |
| | 9 | 25 | bal | — | 31 | — | 0.9 | 10 |
| | 10 | 7 | bal | — | 31 | — | 0.9 | 10 |
| | 11 | 100 | bal | — | 31 | — | 0.9 | 10 |
| | 12 | 23 | — | bal | 31 | — | 0.9 | 10 |
| | 13 | 25 | bal | — | 21 | — | 0.9 | 10 |
| | 14 | 22 | bal | — | 27 | — | 0.9 | 10 |
| | 15 | 27 | bal | — | 27 | — | 0.9 | 10 |
| | 16 | 22 | bal | — | 36 | — | 0.9 | 10 |
| | 17 | 26 | bal | — | 36 | — | 0.9 | 10 |
| | 18 | 27 | bal | — | 35 | — | 0.9 | 10 |
| | 19 | 19 | bal | — | 35 | — | 0.9 | 10 |

| Classification | No | Components: Solid Lubricant (mass %) $MoS_2$ | PTFE | $WS_2$ | h-BN | CF | Properties: Seizure Load [N] | Wear [μm] | Coefficient of friction |
|---|---|---|---|---|---|---|---|---|---|
| Comparative | 1 | — | 26 | — | — | — | 738 | 7 | 0.0110 |
| | 2 | 42 | 10 | — | — | — | more than 1735 | 4 | 0.0056 |
| | 3 | 25 | — | — | — | — | 1405 | 4 | 0.0055 |
| Inventive | 1 | — | 26 | — | — | — | more than 1735 | 1 | 0.0054 |
| | 2 | 6 | — | — | — | — | more than 1735 | 1 | 0.0044 |
| | 3 | — | — | — | — | — | 1183 | 4 | 0.0080 |
| | 4 | 3 | — | — | — | — | more than 1735 | 1 | 0.0044 |
| | 5 | 7 | — | — | — | — | more than 1735 | 1 | 0.0044 |
| | 6 | 11 | — | — | — | — | 1624 | 2 | 0.0039 |
| | 7 | 7 | — | — | — | — | more than 1735 | 1 | 0.0054 |
| | 8 | 25 | — | — | — | — | more than 1735 | 1 | 0.0049 |
| | 9 | 39 | — | — | — | — | more than 1735 | 3 | 0.0038 |
| | 10 | 25 | — | — | — | — | more than 1735 | 2 | 0.0035 |
| | 11 | 25 | — | — | — | — | more than 1735 | 3 | 0.0076 |
| | 12 | 25 | — | — | — | — | more than 1735 | 1 | 0.0065 |
| | 13 | — | 47 | — | — | — | more than 1735 | 1 | 0.0062 |
| | 14 | — | — | 34 | — | — | more than 1735 | 1 | 0.0045 |
| | 15 | — | — | 40 | — | — | more than 1735 | 3 | 0.0040 |
| | 16 | — | — | — | 14 | — | 1624 | 4 | 0.0084 |
| | 17 | — | — | — | 31 | — | 1624 | 5 | 0.0086 |
| | 18 | — | — | — | — | 16 | 1405 | 4 | 0.0090 |
| | 19 | — | — | — | — | 32 | 1405 | 4 | 0.0090 |

INDUSTRIAL APPLICABILITY

As is described hereinabove, the present invention enhances reliability of a swash plate of a swash plate-type compressor and attains cost reduction.

Figure 1:
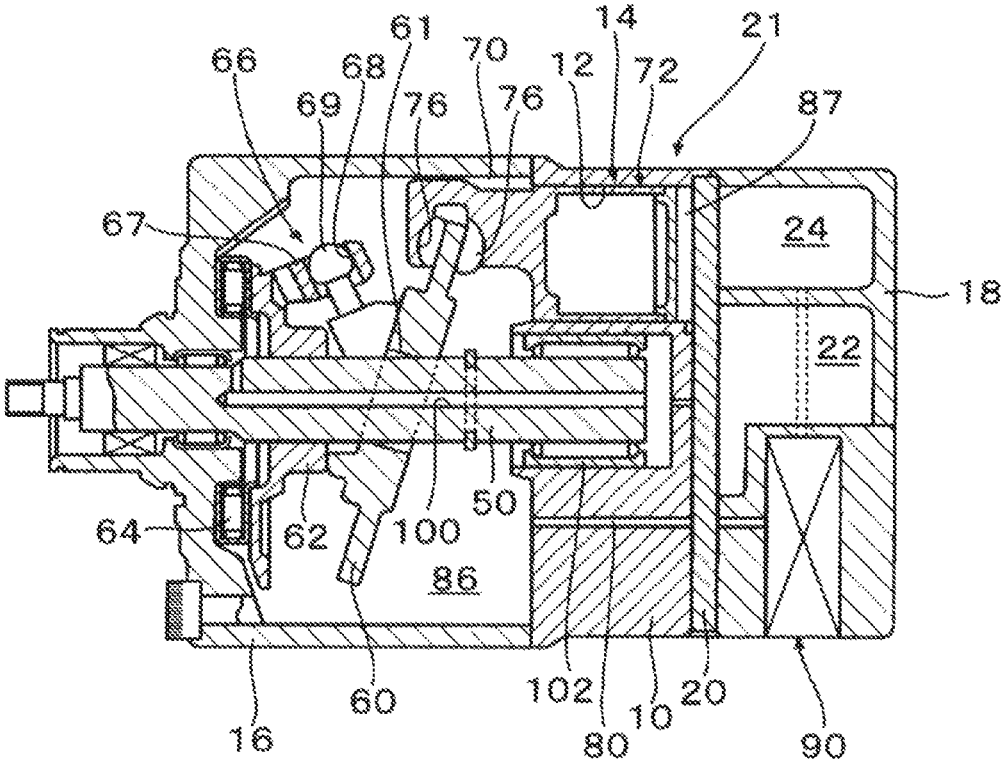
FIG. 1 a cross sectional view of a swash plate-type compressor.
Figure 2:
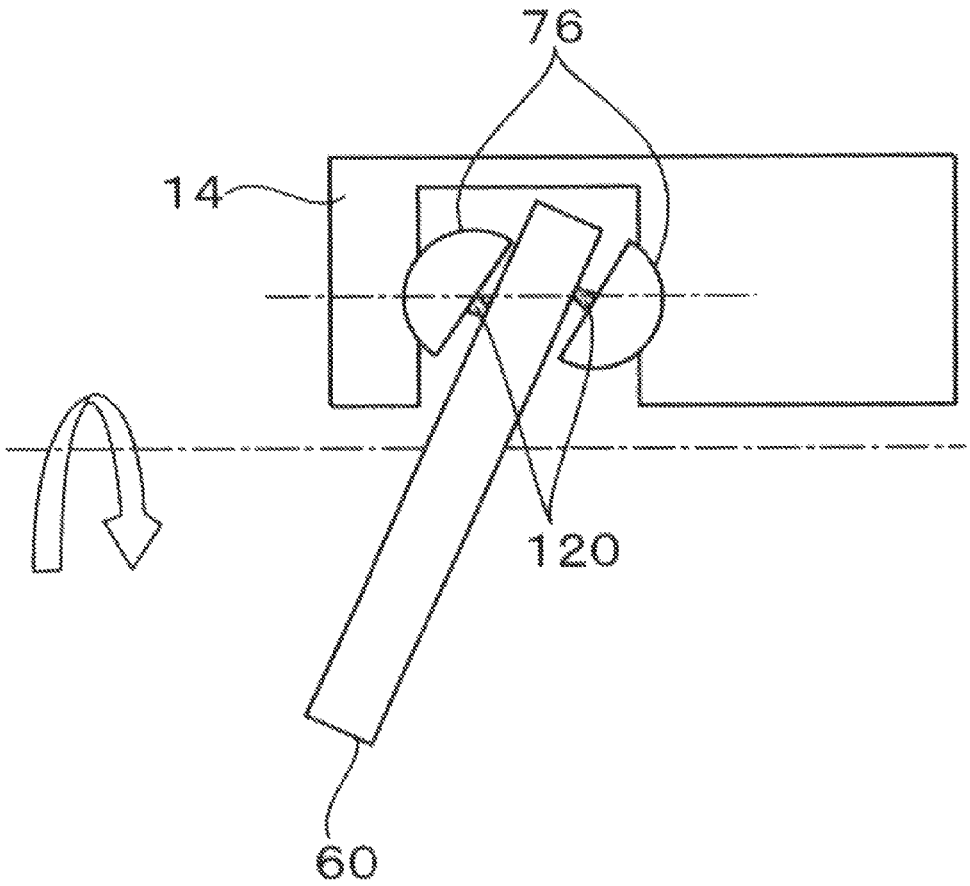
FIG. 2 a schematic view of essential parts of a swash plate-type compressor.
Figure 3:
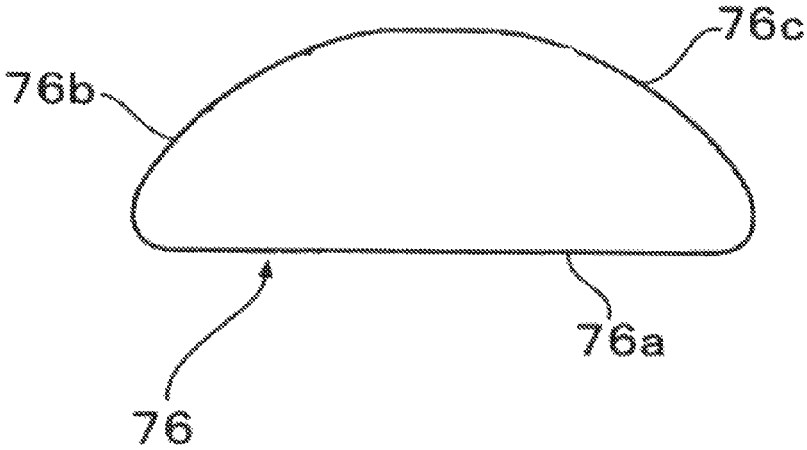
FIG. 3 an enlarged view of a shoe.
Figure 4:
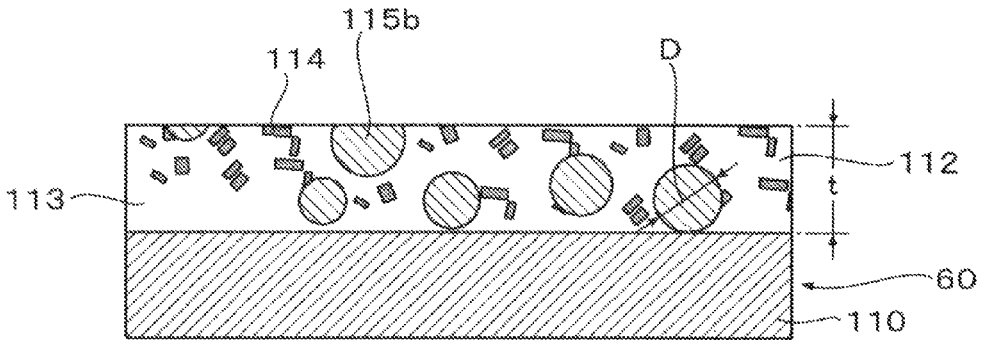
FIG. 4 a schematic view of an iron-based substrate and an inventive coating layer of polyamide-imide resin, in which spherical graphite particles are dispersed.
Figure 5:
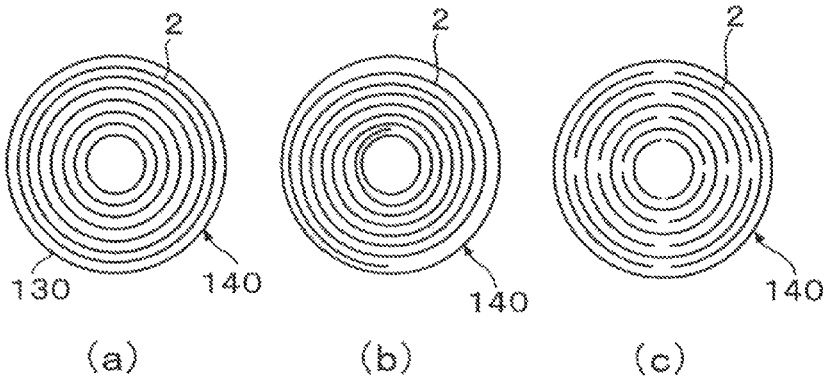
FIG. 5 a schematic view of grooves formed on the surface of a resin-based coating layer.
Figure 6:
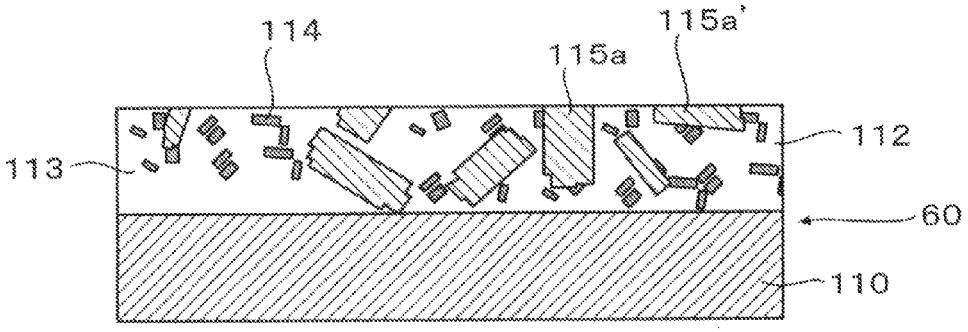
FIG. 6 a schematic view of an iron-based substrate and a conventional coating layer of polyamide-imide resin in which flake-shaped graphite particles are dispersed.
Figure 7:
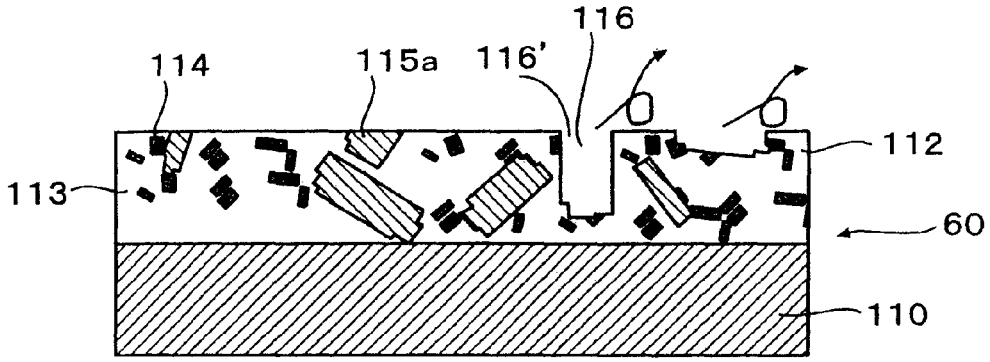
FIG. 7 a schematic drawing showing that the coating layer of FIG. 5 is being wrought or subjected to sliding.
Figure 8:
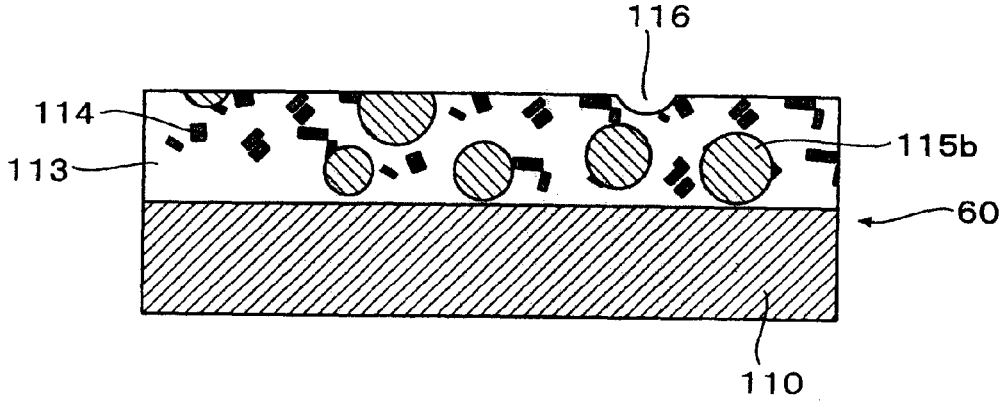
FIG. 8 a schematic drawing showing that the coating layer of FIG. 4 is being wrought or subjected to sliding.
Figure 9:
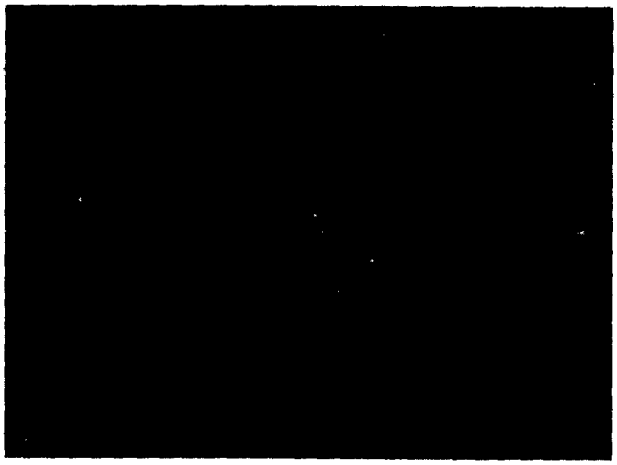
FIG. 9 a photograph of spherical graphite particles according to an inventive example (magnification—100 times)
Figure 10:
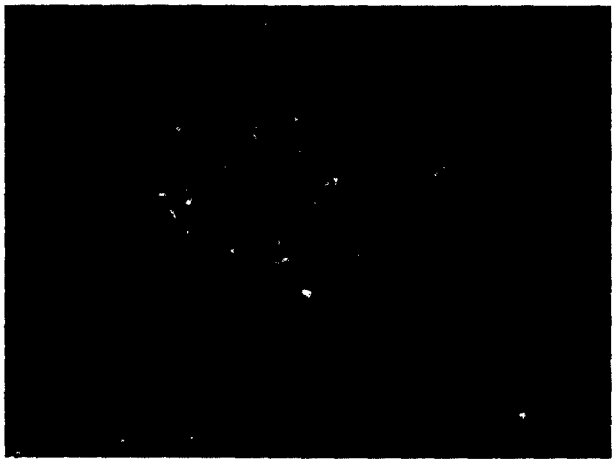
FIG. 10 a photograph of spherical graphite particles according to another inventive example (magnification—200 times)
Figure 11:
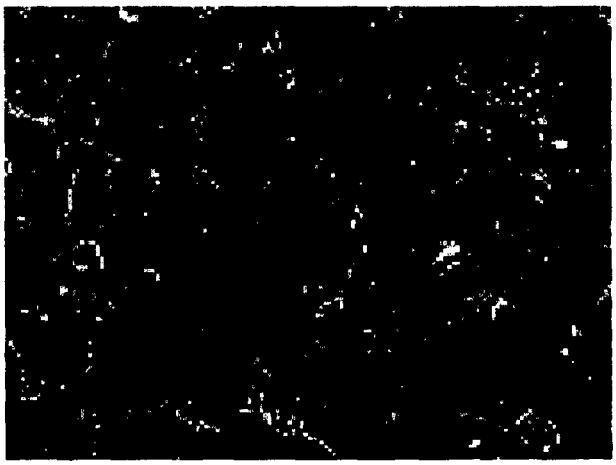
FIG. 11 a photograph of flake-shaped graphite particles according to a comparative example (magnification—100 times)
Figure 12:
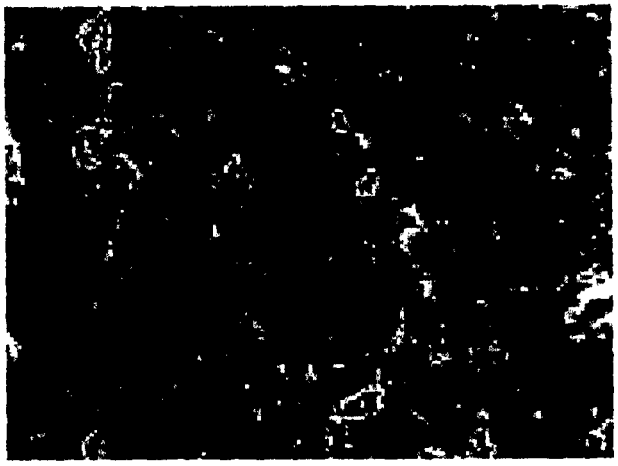
FIG. 12 a photograph of flake-shaped graphite particles according to a comparative example (magnification—200 times)
Figure 13:
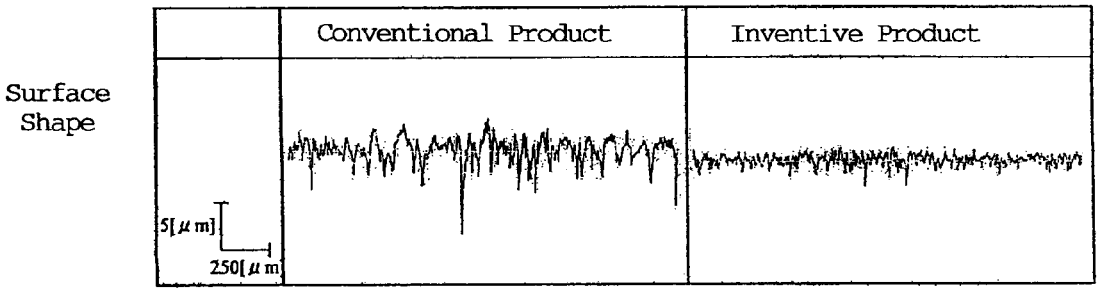
FIG. 13 a drawing showing the roughness of an inventive example (a) and a comparative example (b).

The invention claimed is:

1. A swash plate of a swash plate-type compressor comprising:

a swash plate and shoes which slide thereon, wherein the swash plate is covered with a resin-based coating layer with or without intermediation of an intermediate layer, said coating layer containing 5 to 60 mass % of spherical graphite particles having an average particle diameter of 5 to 50 μm, the balance being one or more species selected from polyimide resin and polyamide-imide resin, with the proviso that said spherical graphite particles, excepting minute particles having a particle diameter 0.5 times or smaller the average particle diameter, have an average shape coefficient ($Y_{AVE}$), as defined below, falling within a range of 1 to 4, and further 70% or more in number of the spherical graphite particles have a shape coefficient (Y), as defined below, within a range of 1 to 1.5, $$Y_{AVE}=\text{total}[\{PM_i^2/4\pi A_i\}]/i$$

$$Y=PM^2/4\pi A$$

wherein, "total" indicates that a value in [ ] is totalized for number "i", "PM" indicates the circumferential length of one particle, "A" indicates a cross sectional area of one particle, and "i" indicates the measurement number.

2. A swash plate of a swash plate-type compressor according to claim 1, wherein concentric or spiral grooves are formed on the surface of said resin-based coating layer, and a ridge is formed between adjacent grooves.

3. A swash plate of a swash plate-type compressor according to claim 1, wherein said resin-based coating layer further contains 1 to 70 mass % of one or more species of $MoS_2$, PTFE, $WS_2$, h-BN, and CF, with the proviso that the total content of the solid lubricant and spherical graphite is 10 to 80 mass %.

4. A swash-plate of a swash plate-type compressor according to claim 1, wherein the degree of graphitization of said spherical graphite is 0.6 or more.

5. A swash-plate of a swash plate-type compressor according to claim 1, wherein the degree of graphitization of said spherical graphite is 0.8 or more, and the average particle ratio ($Y_{AVE}$) of said particles, excepting minute particles having a particle diameter 0.5 times or smaller the average particle diameter falls within a range of 1 to 2.5.

6. A swash plate of a swash plate-type compressor according to claim 1, wherein said substrate is an iron-based substrate.

7. A swash plate of a swash plate-type compressor according to claim 6, wherein said swash plate-type compressor is of a displacement variable type.

* * * * *